US011810458B2

(12) United States Patent
Honda et al.

(10) Patent No.: US 11,810,458 B2
(45) Date of Patent: Nov. 7, 2023

(54) PARKING LOT MANAGEMENT SYSTEM, PARKING LOT MANAGEMENT METHOD, AND STORAGE MEDIUM

(71) Applicant: TOYOTA JIDOSHA KABUSHIKI KAISHA, Toyota (JP)

(72) Inventors: Daisaku Honda, Nagoya (JP); Hiroya Matsubayashi, Nisshin (JP); Ryota Tomizawa, Mishima (JP); Satoshi Tanabe, Susono (JP); Nobutsugu Maruiwa, Mishima (JP); Yasuhiro Kobatake, Nagoya (JP); Hiroki Awano, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/850,049

(22) Filed: Jun. 27, 2022

(65) Prior Publication Data

US 2023/0055909 A1 Feb. 23, 2023

(30) Foreign Application Priority Data

Aug. 20, 2021 (JP) ..... 2021-135152

(51) Int. Cl.
*G08G 1/14* (2006.01)

(52) U.S. Cl.
CPC ..... *G08G 1/145* (2013.01)

(58) Field of Classification Search
CPC ..... G08G 1/145
USPC ..... 340/425.5
See application file for complete search history.

(56) References Cited

U.S. PATENT DOCUMENTS 8,884,784 B2 * 11/2014 Kirsch ..... G08G 1/143 340/932.2
2014/0297072 A1 * 10/2014 Freeman ..... B60L 53/14 136/246
2016/0238399 A1 * 8/2016 Caira ..... G08G 1/146
2022/0024450 A1 * 1/2022 Roh ..... B62D 15/0285

FOREIGN PATENT DOCUMENTS

CN 114120695 A * 3/2022 ..... B60W 30/06
WO 2016/072165 A1 5/2016

* cited by examiner

*Primary Examiner* — Kam Wan Ma
(74) *Attorney, Agent, or Firm* — Sughrue Mion, PLLC

(57) ABSTRACT

A parking lot management system includes an infrastructure sensor that is able to detect a sunlight state of a parking space in a parking lot, and a notification device that notifies at least one of a vehicle including a solar power generation function and a user of the parking lot of the sunlight state of each parking space detected by the infrastructure sensor.

8 Claims, 6 Drawing Sheets

| | | TIME | | | |
|---|---|---|---|---|---|
| | | 12:40 –12:50 | 12:50 –13:00 | 13:00 –13:10 | 13:10 –13:20 |
| PARKING SPACE | $P_1$ | 0% | 0% | 0% | 0% |
| | $P_2$ | 0% | 0% | 0% | 0% |
| | | ⋮ | ⋮ | ⋮ | ⋮ |
| | $P_n$ | 0% | 30% | 60% | 100% |
| | | ⋮ | ⋮ | ⋮ | ⋮ |
| | $P_m$ | 100% | 100% | 100% | 100% |
| | | ⋮ | ⋮ | ⋮ | ⋮ |

PARKING LOT MANAGEMENT SYSTEM, PARKING LOT MANAGEMENT METHOD, AND STORAGE MEDIUM

CROSS-REFERENCE TO RELATED APPLICATION

This application claims priority to Japanese Patent Application No. 2021-135152 filed on Aug. 20, 2021, incorporated herein by reference in its entirety.

BACKGROUND

1. Technical Field

The present disclosure relates to a parking lot management system, a parking lot management method, and a storage medium.

2. Description of Related Art

A travel control device for an autonomous vehicle equipped with a solar cell panel is known in which an autonomous vehicle is caused to travel to a solar power generation place by autonomous driving in a case where predicted charging amount when a battery is charged by solar power generation in the solar power generation place is larger than predicted charging amount when the battery is charged by solar power generation in a current position even when power consumption during a round trip between the current position of the autonomous vehicle and the solar power generation place is considered (see, for example, WO 2016/072165).

SUMMARY

However, this travel control device does not detect whether the parking location of the autonomous vehicle in the solar power generation place is actually exposed to sunlight, and therefore, there is a problem that it is unclear whether the battery can be fully charged even when the autonomous vehicle is moved to the solar power generation place.

In order to solve such a problem, according to the present disclosure, a parking lot management system is provided. The parking lot management system includes an infrastructure sensor that is able to detect a sunlight state of a parking space in a parking lot, and a notification device that notifies at least one of a vehicle including a solar power generation function and a user of the parking lot of the sunlight state of each parking space detected by the infrastructure sensor.

Further, the present disclosure provides a parking lot management method. The parking lot management method includes, by using an infrastructure sensor that is able to detect a sunlight state of a parking space in a parking lot, notifying at least one of a vehicle including a solar power generation function and a user of the parking lot of the sunlight state of each parking space detected by the infrastructure sensor.

Further, the present disclosure provides a storage medium storing a program that causes a computer to function, by using an infrastructure sensor that is able to detect a sunlight state of a parking space in a parking lot, notifying at least one of a vehicle including a solar power generation function and a user of the parking lot of the sunlight state of each parking space detected by the infrastructure sensor.

It is possible to make good use of the solar power generation function of the vehicle.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1A:
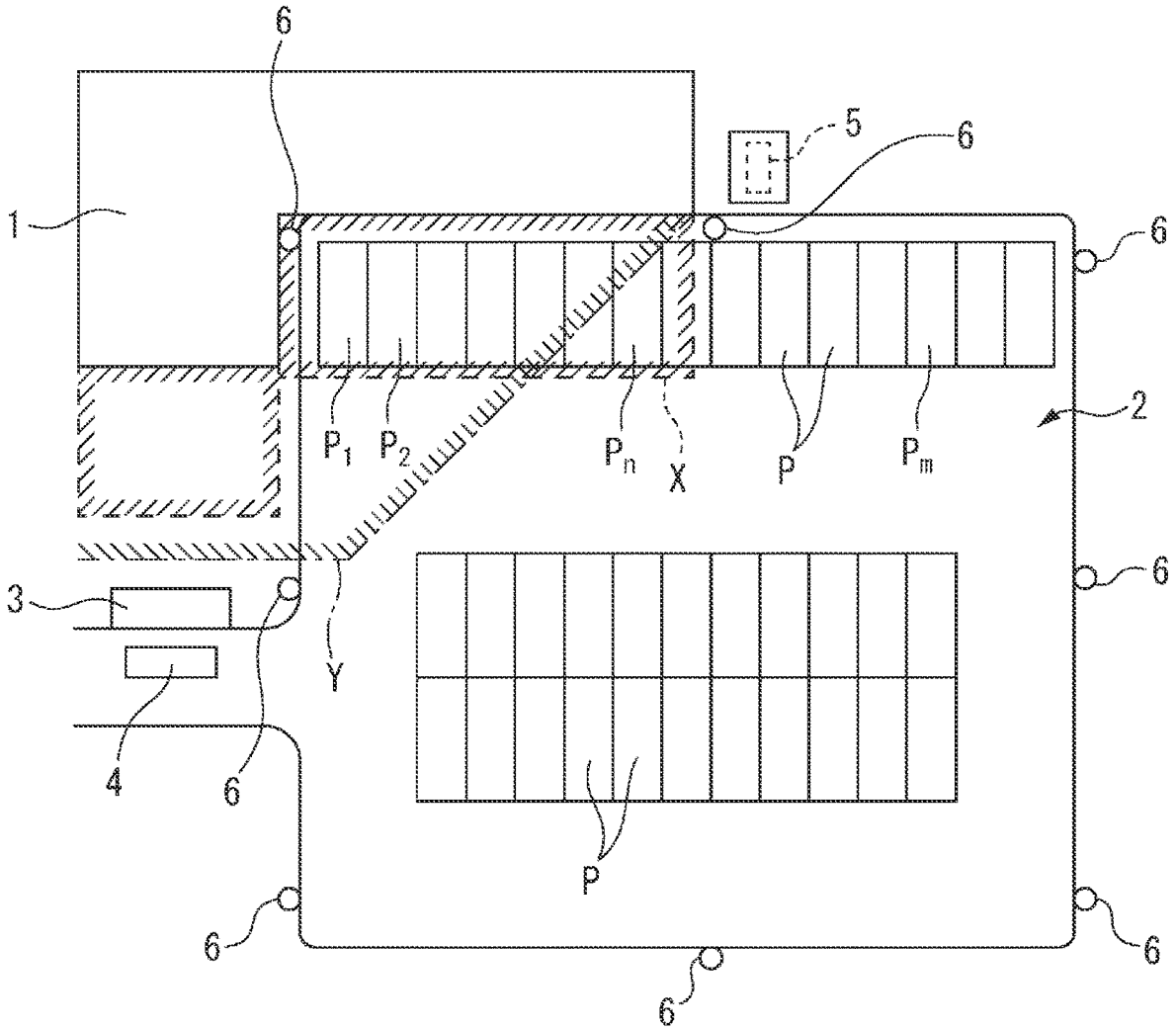
FIG. 1A is a plan view of an example of an automatic parking lot illustrated graphically.
Figure 1B:
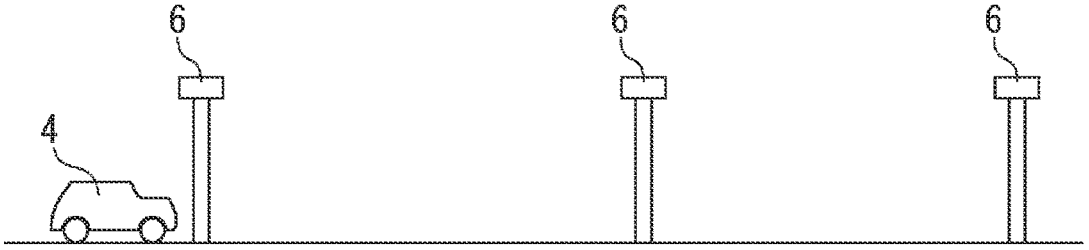
FIG. 1B is a side view of an example of the automatic parking lot illustrated graphically.

FIG. 1A is a plan view graphically illustrating an automatic parking lot, and FIG. 1B is a side view of the automatic parking lot shown in FIG. 1A. Referring to FIGS. 1A and 1B, the numeral 1 indicates a facility such as a department store, the numeral 2 indicates an automatic parking lot installed adjacent to a facility 1, the numeral 3 indicates a boarding and alighting place, and the numeral 4 indicates an autonomous vehicle stopped at a boarding and alighting place 3. As shown in FIG. 1A, a large number of parking spaces P are provided in the automatic parking lot 2. In this automatic parking lot 2, an automatic parking service, that is, an automated valet parking service is performed in which the autonomous vehicle 4 that has reached the boarding and alighting place 3 is autonomously driven to an empty parking space P, and autonomous vehicles parked in the parking spaces P are autonomously driven to the boarding and alighting place 3. On the other hand, in FIG. 1A, the numeral 5 indicates a parking management server disposed in a parking management facility. In this automatic parking lot 2, a manually driven vehicle can also be parked.

In a case where a user who uses this automatic parking service parks an own vehicle in the automatic parking lot 2, for example, when the own vehicle capable of performing autonomous driving reaches the boarding and alighting place 3, for example, the user transmits an entry request together with a vehicle identification (ID) for identifying the own vehicle to the parking management server 5 via a communication network from a mobile terminal of the user. Upon receiving the entry request, the parking management server 5 sets a travel route for the vehicle such that the vehicle can reach the empty parking space P from the boarding and alighting place 3 without coming into contact with other vehicles and pedestrians, and transmits the set travel route to the vehicle of the user. When the vehicle of the user receives the set travel route from the parking management server 5, the vehicle of the user performs autonomous driving along the set travel route to be moved from the boarding and alighting place 3 to the empty parking space P.

On the other hand, the same applies when the vehicle leaves the automatic parking lot 2. For example, when the user arrives at the boarding and alighting place 3, the user transmits a leaving request together with the vehicle ID for identifying the own vehicle to the parking management server 5 via the communication network from the mobile terminal of the user. Upon receiving the leaving request, the parking management server 5 sets a travel route for the vehicle such that the vehicle can reach the boarding and alighting place 3 from the parking space P where the vehicle is parked without coming into contact with other vehicles and pedestrians, and transmits the set travel route to the vehicle of the user. When the vehicle of the user receives the set travel route from the parking management server 5, the vehicle of the user performs autonomous driving along the set travel route to be moved from the parking space P where the vehicle is parked to the boarding and alighting place 3.

As shown in FIG. 1A, multiple infrastructure sensors 6 are installed in the automatic parking lot 2 so as to be able to detect the state of the entire area in the automatic parking lot 2, and these infrastructure sensors 6 are installed at higher positions than the vehicle, as shown in FIG. 1B. A camera, a laser sensor, or the like can be used as the infrastructure sensors 6, but a case in which a camera is used as the infrastructure sensors 6 will be described below as an example. That is, a case in which the image of the inside of the automatic parking lot 2 is captured by the infrastructure sensors 6 will be described as an example. In this case, each infrastructure sensor 6 captures images of all the parking spaces P and all passages between the parking spaces P in the automatic parking lot 2, and the image signal captured by each infrastructure sensor 6 is transmitted to the parking management server 5. In the parking management server 5, the travel route of the autonomous vehicle at the time of entering and leaving the parking lot is set based on these image signals.

Figure 2:
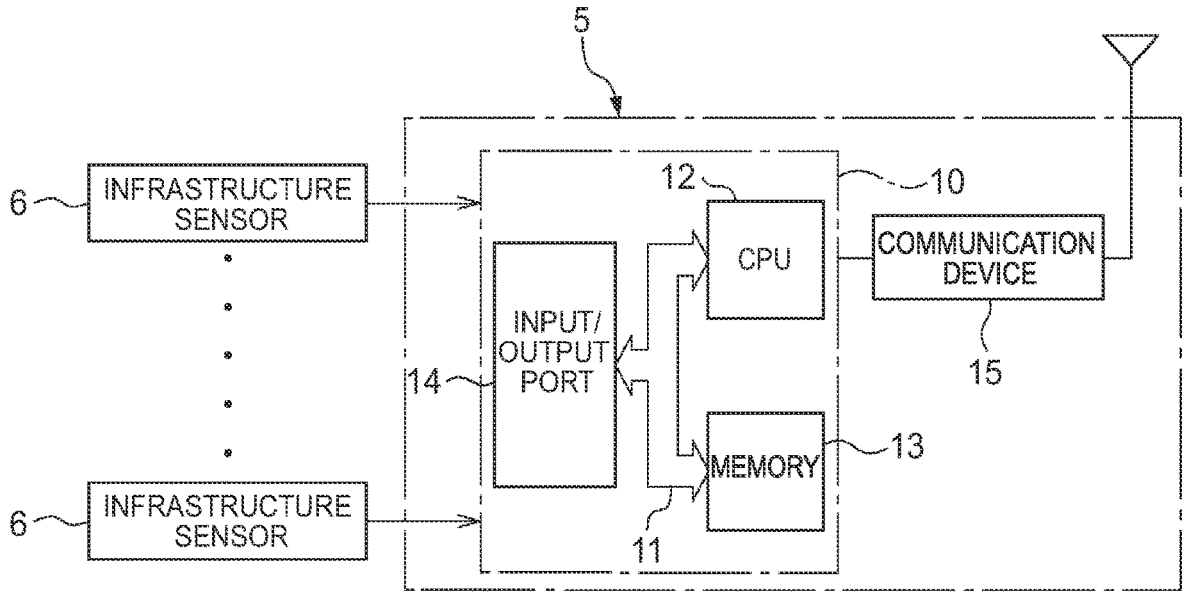
FIG. 2 is a diagram graphically illustrating a parking management server.

FIG. 2 shows the parking management server 5 of FIG. 1A. As shown in FIG. 2, an electronic control unit 10 is installed in this parking management server 5. The electronic control unit 10 is composed of a digital computer, and includes a central processing unit (CPU) (microprocessor) 12, a memory 13 composed of a read-only memory (ROM) and a random access memory (RAM), and an input/output port 14 that are connected to each other by a bidirectional bus 11. As shown in FIG. 2, the image signal captured by each infrastructure sensor 6 is input to the electronic control unit 10. Further, the map data of the automatic parking lot 2 is stored in the memory 13 of the electronic control unit 10.

Figure 3:
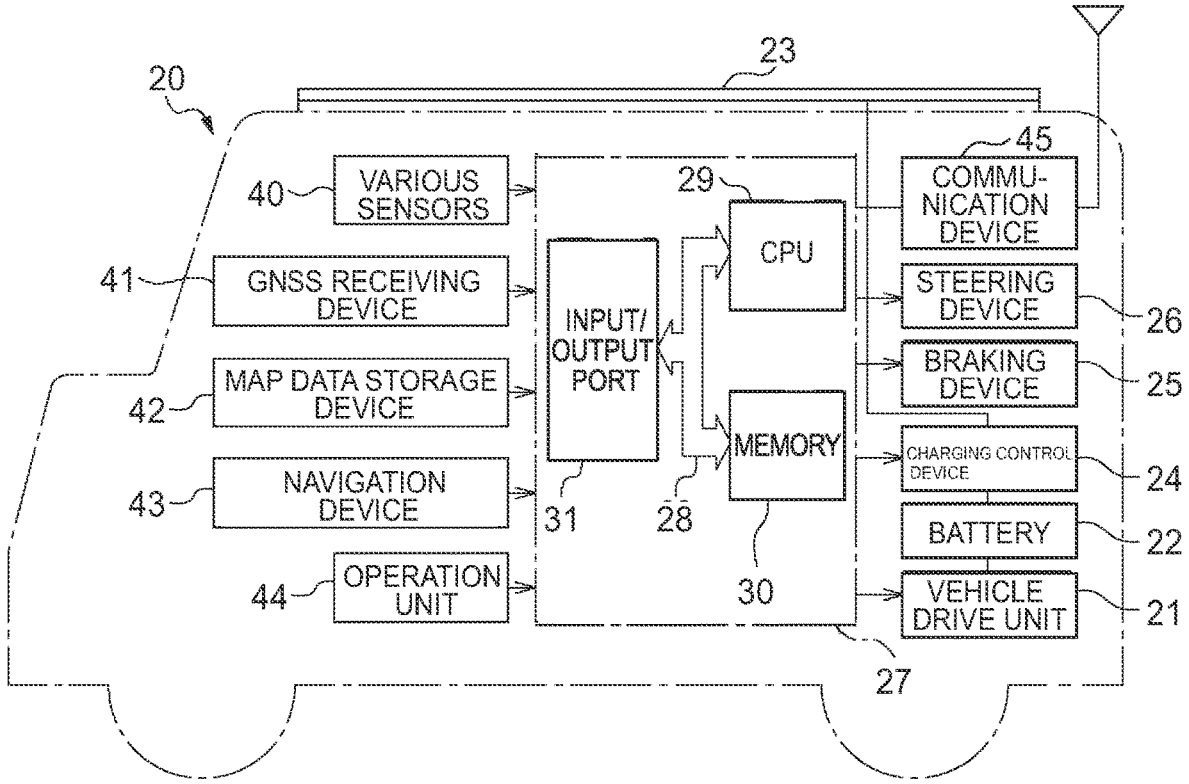
FIG. 3 is a diagram graphically illustrating an autonomous vehicle.

FIG. 3 graphically shows an example of an autonomous vehicle 20 including a solar power generation function. Referring to FIG. 3, the numeral 21 indicates a vehicle drive unit for applying a driving force to drive wheels of the vehicle 20, the numeral 22 indicates a battery for supplying electric power to the vehicle drive unit 21, the numeral 23 indicates a solar cell panel installed on a roof of the vehicle 20, the numeral 24 indicates a charging control device for charging the battery 22 with electric power generated in the solar cell panel 23, the numeral 25 indicates a braking device for braking the vehicle 20, the numeral 26 indicates a steering device for steering the vehicle 20, and the numeral 27 indicates an electronic control unit mounted on the vehicle 20. As shown in FIG. 3, the electronic control unit 27 is composed of a digital computer, and includes a CPU (microprocessor) 29, a memory 30 composed of a ROM and a RAM, and an input/output port 31 that are connected to each other by a bidirectional bus 28.

On the other hand, as shown in FIG. 3, the vehicle 20 is provided with various sensors 40 necessary for the vehicle 20 to perform autonomous driving, that is, a sensor for detecting the state of the vehicle 20 and a peripheral detection sensor for detecting the periphery of the vehicle 20. In this case, an acceleration sensor, a speed sensor, and an azimuth angle sensor are used as the sensors for detecting the state of the vehicle 20, and an on-board camera for capturing images of the front, the side, and the rear of the vehicle 20 or the like, light detection and ranging (LIDAR), a radar, and the like are used as the peripheral detection sensors for detecting the periphery of the vehicle 20. Further, the vehicle 20 is provided with a Global Navigation Satellite System (GNSS) receiving device 41, a map data storage device 42, a navigation device 43, and an operation unit 44 for performing various operations. The GNSS receiving device 41 can detect the current position of the vehicle 20 (for example, the latitude and longitude of the vehicle 20) based on the information obtained from a plurality of artificial satellites. Therefore, the current position of the vehicle 20 can be acquired by the GNSS receiving device 41. As the GNSS receiving device 41, for example, a global positioning system (GPS) receiving device is used.

On the other hand, the map data storage device 42 stores map data and the like necessary for the vehicle 20 to perform autonomous driving. These various sensors 40, the GNSS receiving device 41, the map data storage device 42, the navigation device 43, and the operation unit 44 are connected to the electronic control unit 27. Further, the vehicle 20 is provided with a communication device 45 for communicating with the parking management server 5, and as shown in FIG. 2, the parking management server 5 is provided with a communication device 15 for communicating with the vehicle 20. In the example shown in FIG. 3, the vehicle drive unit 21 is composed of an electric motor driven by the battery 22, and the drive wheels of the vehicle 20 are driven and controlled by the electric motor in accordance with the output signal of the electronic control unit 27. Further, the braking control of the vehicle 20 is executed by the braking device 25 in accordance with the output signal from the electronic control unit 27. The steering control of the vehicle 20 is executed by the steering device 26 in accordance with the output signal from the electronic control unit 27.

In order to efficiently generate solar power by the solar cell panel 23 while the autonomous vehicle 20 is parked in the automatic parking lot 2, the vehicle 20 needs to be parked in the parking space P exposed to sunlight. For that purpose, it is necessary to determine which parking space P is actually exposed to sunlight. On the other hand, in this case, from the image captured by each infrastructure sensor 6, it is possible to identify the sunlight area and the shaded area in all the parking spaces P and all the passages between the parking spaces P in the automatic parking lot 2. Therefore, in the embodiment according to the present disclosure, the sunlight area is identified based on the image captured by each infrastructure sensor 6 such that the vehicle 20 is parked in the parking space P actually exposed to sunlight.

Next, the outline of the present disclosure will be described referring to FIGS. 1A, 4 and 5, based on a specific example. First, referring to FIG. 1A, in FIG. 1A, the area X surrounded by the broken line (only an area around the area is hatched) indicates a shaded area by the facility 1 at noon one day. The area Y surrounded by the alternate long and short dash line (only a part around the area is hatched)

indicates a shaded area by the facility 1 in the evening on the same day. As described above, the positions of the shaded areas X and Y change during the day, and the positions thereof also change due to seasonal differences such as spring, summer, autumn, and winter. Further, even when a structure or the like that blocks sunlight is installed in the automatic parking lot 2 or in the vicinity of the automatic parking lot 2, the shaded areas change. Therefore, the sunlight area in the automatic parking lot 2 cannot be determined only from the weather.

Therefore, in the embodiment according to the present disclosure, the sunlight area is specified from the image captured by each infrastructure sensor 6. In this case, when the ratio of the part exposed to sunlight in the area of each parking space P is referred to as a degree of sunlight R, in the embodiment according to the present disclosure, the degree of sunlight R in each parking space P is calculated from the image captured by each infrastructure sensor 6. FIG. 4 shows a change in the degree of sunlight R from 6:00 to 18:00 on a certain day in typical parking spaces $P_1$, $P_2$, $P_n$, and $P_m$ of the parking spaces P shown in FIG. 1A. FIG. 5 shows a list of changes in the degree of sunlight R in the typical parking spaces $P_1$, $P_2$, $P_n$, and $P_m$ during part of the time from 6:00 to 18:00 on the same day. In the example shown in FIG. 5, the change in the degree of sunlight R is shown every 10 minutes.

Figure 6:
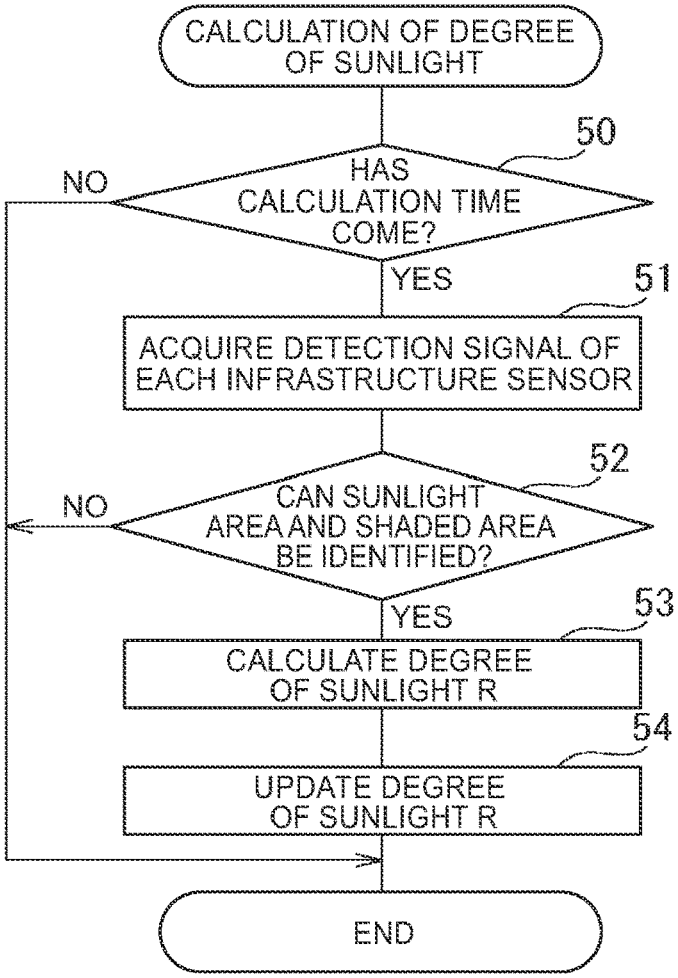
FIG. 6 is a flowchart for calculating the degree of sunlight R.

Next, referring to FIG. 6, a calculation method of the degree of sunlight R will be described. FIG. 6 shows a calculation routine of the degree of sunlight for calculating the degree of sunlight R, and this routine is repeatedly executed in the electronic control unit 10 of the parking management server 5. Referring to FIG. 6, first, in step 50, it is determined whether the calculation time of the degree of sunlight R has come. In the embodiment according to the present disclosure, as shown in FIG. 5, the degree of sunlight R is obtained every 10 minutes. For example, at 6:00, 6:10, and 6:20, the degree of sunlight R is calculated. In step 50, when it is determined that the calculation time of the degree of sunlight R has not come, the processing cycle ends, and when it is determined that the calculation time of the degree of sunlight R has come, the process proceeds to step 51.

In step 51, the detection signal of each infrastructure sensor 6, that is, the image signal is acquired. Next, in step 52, it is determined from these image signals whether the sunlight area and the shaded area can be identified. For example, when it is sunny, it is determined that the sunlight area and the shaded area can be identified, and when the sun is not shining, for example, when it is cloudy, it is determined that the sunlight area and the shaded area cannot be identified. In step 52, when it is determined that the sunlight area and the shaded area cannot be identified, the processing cycle ends, and when it is determined that the sunlit area and the shaded area can be identified, the process proceeds to step 53.

In step 53, based on the map data of the automatic parking lot 2 stored in the memory 13 of the electronic control unit 10 of the parking management server 5, from the acquired image signal of each infrastructure sensor 6, the sunlight area on the plane map of the automatic parking lot 21 shown in FIG. 1A is specified, and from the specified sunlight area and the position of each parking space P, the degree of sunlight R of each parking space P is calculated. When the degree of sunlight R is calculated, the process proceeds to step 54, and the degree of sunlight R of each parking space P stored in the memory 13 of the electronic control unit 10 of the parking management server 5 is updated. Therefore, when the sunlight area and the shaded area can be identified from each other, the current actual degree of sunlight R of each parking space P is stored in the memory 13, and when the sunlit area and the shaded area cannot be identified from each other, the actual degree of sunlight R of each parking space P previously updated, that is, the latest actual degree of sunlight R of each parking space P is stored in the memory 13.

Figure 7:
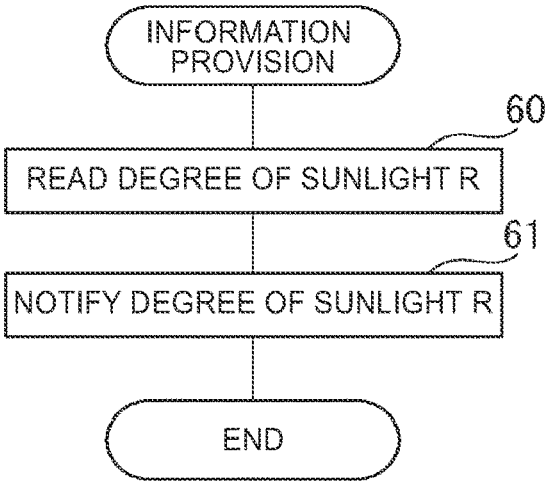
FIG. 7 is a flowchart for providing information.

FIG. 7 shows an information provision routine for providing information on the degree of sunlight R, and this routine is repeatedly executed in the electronic control unit 10 of the parking management server 5.

Referring to FIG. 7, first, in step 60, the degree of sunlight R of each parking space P stored in the memory 13 is read. Next, in step 61, the degree of sunlight R of each parking space P is notified to the vehicle 20 including the solar power generation function or a subject who needs to obtain information on the degree of sunlight R of each parking space P such as a user of the automatic parking lot 2. In this case, there are various methods for notifying the information on the degree of sunlight R of each parking space P. For example, the parking management server 5 can be configured such that the information on the degree of sunlight R of each parking space P can be browsed when the parking management server 5 is accessed, and the information on the degree of sunlight R of each parking space P can be notified to a subject who needs to obtain the information via a communication network from the parking management server 5.

As described above, in the embodiment according to the present disclosure, the infrastructure sensor 6 capable of detecting the sunlight state of the parking space P in the parking lot 2 and a notification device for notifying at least one of the vehicle 20 including the solar power generation function and the user of the parking lot 2 of the sunlight state of each parking space P detected by the infrastructure sensor 6 are provided. In this case, in the embodiment according to the present disclosure, the parking management server 5 constitutes this notification device.

Further, in the embodiment according to the present disclosure, the sunlight state of each parking space P for regular time intervals is notified to at least one of the vehicle 20 including the solar power generation function and the user of the parking lot 2. Further, in the embodiment according to the present disclosure, when the infrastructure sensor 6 can detect the current actual sunlight state of the parking space P in the parking lot 2, the current actual sunlight state of the parking space P in the parking lot 2 is notified to at least one of the vehicle 20 including the solar power generation function and the user of the parking lot 2, and when the infrastructure sensor 6 cannot detect the current actual sunlight state of the parking space P in the parking lot 2, the latest actual sunlight state of the parking space P is notified to at least one of the vehicle 20 including the solar power generation function and the user of the parking lot 2.

Further, in the embodiment according to the present disclosure, based on the sunlight state of each parking space P detected by the infrastructure sensor 6, the degree of sunlight R is obtained for each parking space P, and this degree of sunlight R is notified to at least one of the vehicle 20 including the solar power generation function and the user of the parking lot 2.

Further, the embodiment according to the present disclosure provides a parking lot management method in which by using the infrastructure sensor 6 capable of detecting the sunlight state of the parking space P in the parking lot 2, the sunlight state of each parking space P detected by the infrastructure sensor 6 is notified to at least one of the vehicle 20 including the solar power generation function and the user of the parking lot 2.

Further, the embodiment according to the present disclosure provides a program that causes a computer to function, by using the infrastructure sensor 6 capable of detecting the sunlight state of the parking space P in the parking lot 2, notifying at least one of the vehicle 20 including the solar power generation function and the user of the parking lot 2 of the sunlight state of each parking space P detected by the infrastructure sensor 6. The program is stored in a storage medium.

Figure 8:
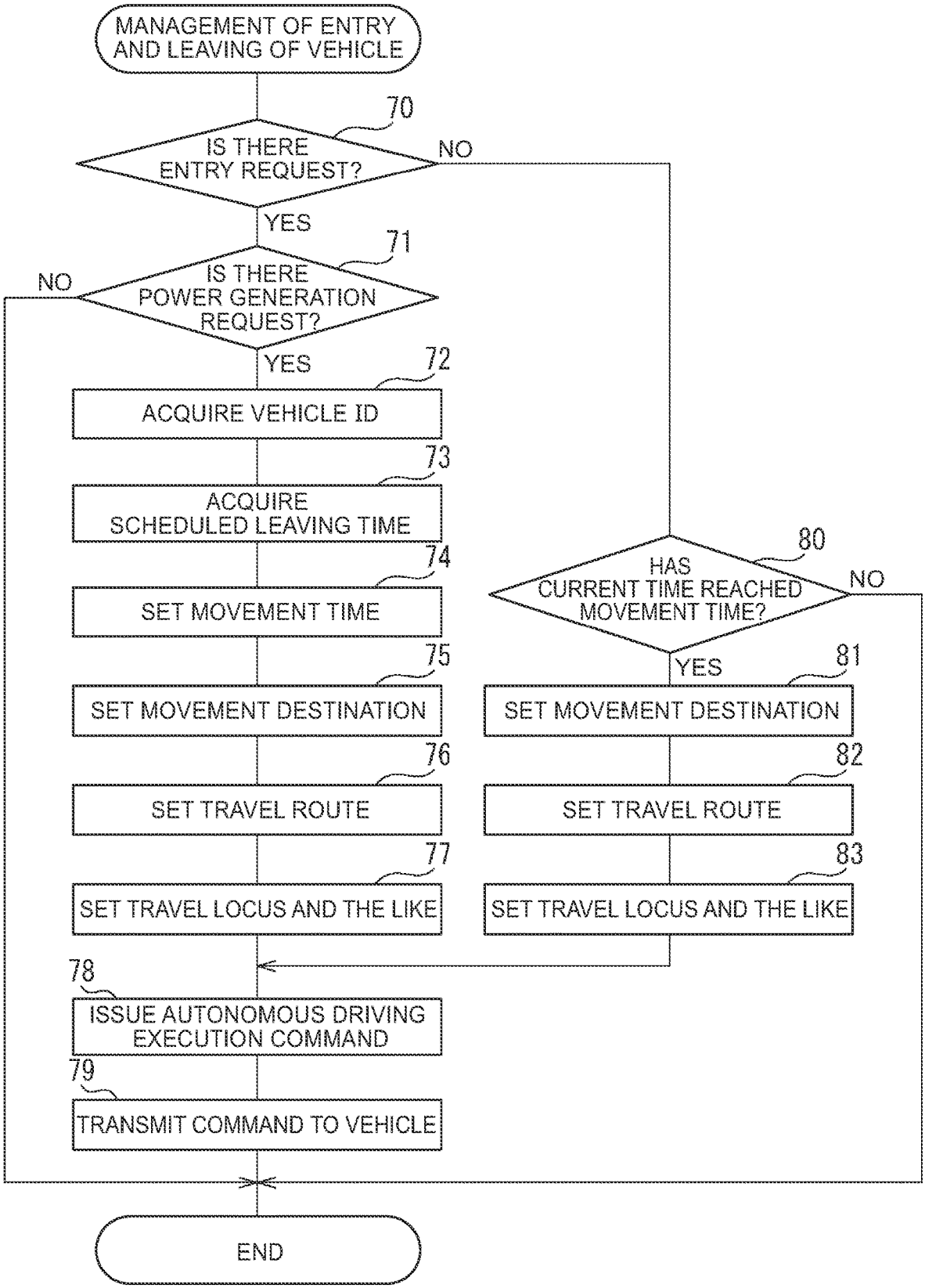
FIG. 8 is a flowchart for managing entry and leaving of a vehicle.

Next, a method of entering and leaving the automatic parking lot 2 that is applied when the user of the automatic parking service parks the autonomous vehicle 20 in the automatic parking lot 2 in order for the solar cell panel 23 to generate solar power while the autonomous vehicle 20 is parked in the automatic parking lot 2 will be described. FIG. 8 shows an entry and leaving management routine for performing the method of entering and leaving the automatic parking lot 2, and this routine is repeatedly executed in the electronic control unit 10 of the parking management server 5.

Referring to FIG. 8, first, in step 70, it is determined whether there is an entry request to the automatic parking lot 2. When it is determined that there is an entry request to the automatic parking lot 2, the process proceeds to step 71, and it is determined whether there is a power generation request for generating solar power by the solar cell panel 23 while the autonomous vehicle 20 is parked. When it is determined that there is no power generation request for generating solar power by the solar cell panel 23, the processing cycle ends. On the other hand, when it is determined that there is a power generation request for generating solar power by the solar cell panel 23, the process proceeds to step 72, and the vehicle ID of the autonomous vehicle 20 is acquired. When an entry request to the automatic parking lot 2 is made, registration of the scheduled leaving time is requested, and in step 73, the registered scheduled leaving time is acquired. Next, in step 74, the movement time for moving the autonomous vehicle 20 to another parking location before the scheduled leaving time is set. This movement time is, for example, 30 minutes before the scheduled leaving time.

Figures 4, 5:
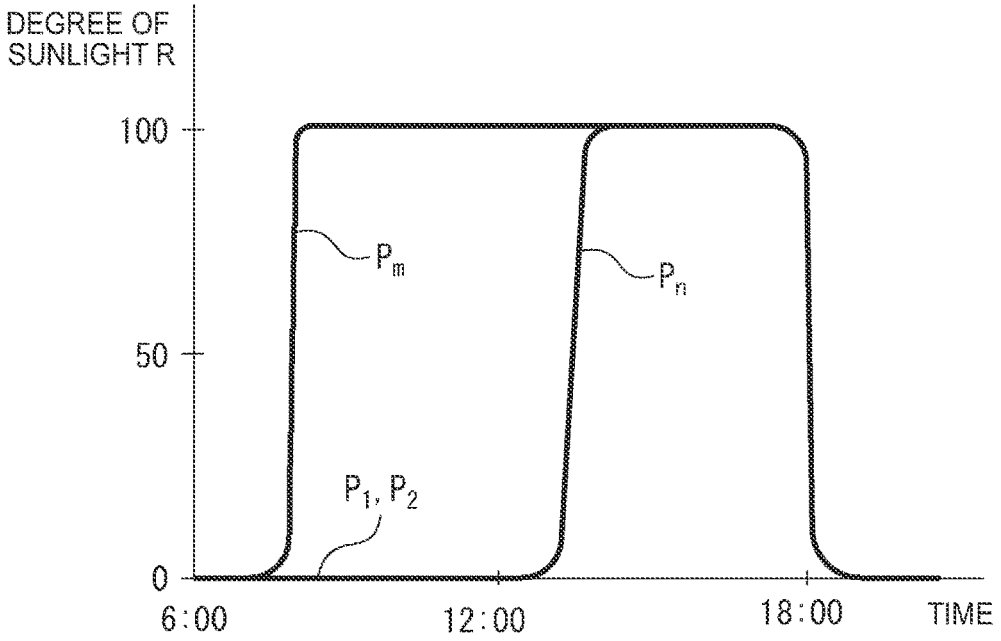
FIG. 4 is a diagram showing a degree of sunlight R.
FIG. 5 is a diagram showing a chart of the degree of sunlight R.

Then, in step 75, based on the list shown in FIG. 5, from the entry time to the movement time, an empty parking space P having a high degree of sunlight R, preferably an empty parking space P having a degree of sunlight R of 100% is searched, and an empty parking space P having a high degree of sunlight R is set as a movement destination. Next, in step 76, a travel route from the boarding and alighting place 3 to the set movement destination is set based on the map data of the automatic parking lot 2 stored in the memory 13. Next, in step 77, based on the map data of the automatic parking lot 2 stored in the memory 13 and the image signal of the infrastructure sensor 6, the travel locus and the travel speed of the autonomous vehicle 20 at which the autonomous vehicle 20 does not come into contact with other vehicles and pedestrians are determined.

In this case, when the autonomous vehicle 20 reaches the movement destination and is parked in the set parking space P, the travel locus and the travel speed of the autonomous vehicle 20 in addition to the parking posture of the autonomous vehicle 20 to the set parking space P can be determined such that the rear side of the autonomous vehicle 20 is exposed to higher sunlight than the front side thereof. As described above, exposing the rear side of the autonomous vehicle 20 to higher sunlight than the front side thereof has advantages that faded headlights can be suppressed and heating of a drive recorder can be suppressed. Next, in step 78, an autonomous driving execution command for the autonomous vehicle 20 is issued, and then in step 79, the set movement destination, travel route, travel locus, and travel speed, and the autonomous driving execution command are transmitted to the autonomous vehicle 20 from the parking management server 5.

Figure 9:
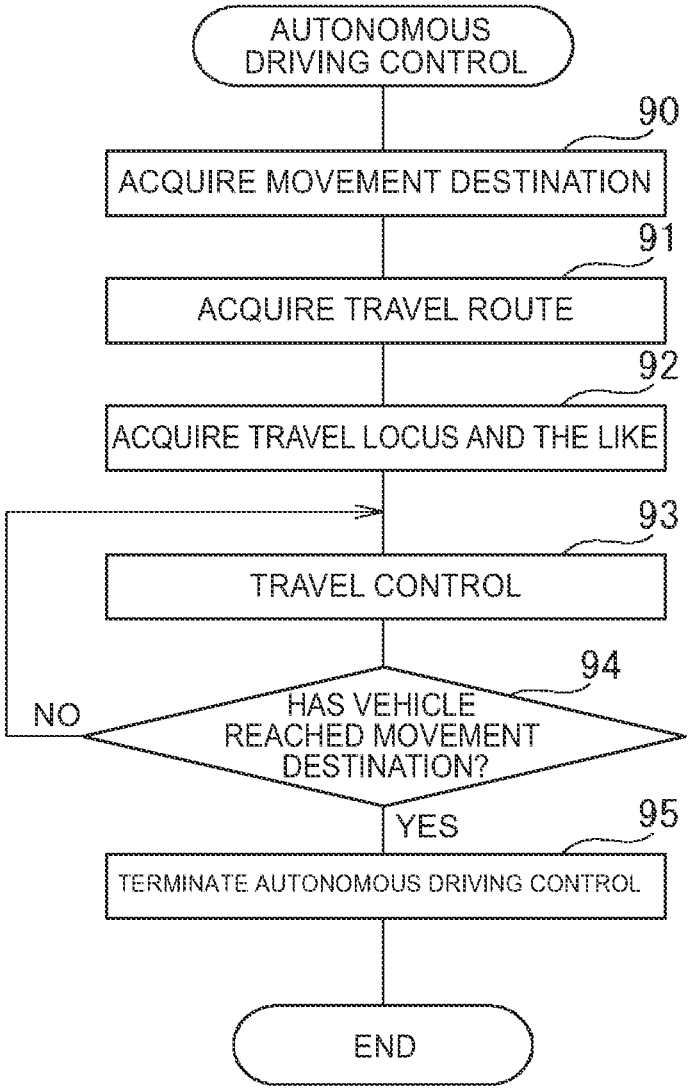
FIG. 9 is a flowchart for performing autonomous driving control.

When the autonomous driving execution command is transmitted from the parking management server 5 to the autonomous vehicle 20, the autonomous driving control of the autonomous vehicle 20 is started. FIG. 9 shows a vehicle driving control routine for performing autonomous driving control of the autonomous vehicle 20, and this routine is repeatedly executed in the electronic control unit 27 mounted on the vehicle 20.

Referring to FIG. 9, first, in step 90, the movement destination set in the parking management server 5 is acquired, and then in step 91, the travel route set in the parking management server 5 is acquired. In step 92, the travel locus and the travel speed set in the parking management server 5 are acquired. Next, in step 93, the travel control for the autonomous vehicle 20 is performed along the set travel locus so as not to come into contact with other vehicles and pedestrians based on the detection result of a camera for capturing an image of the front or the like of the autonomous vehicle 20, a LIDAR, and a radar. Next, in step 94, it is determined whether the autonomous vehicle 20 has reached the movement destination. When it is determined that the autonomous vehicle 20 has not reached the movement destination, the process returns to step 93, and the autonomous driving of the autonomous vehicle 20 is continued. On the other hand, when it is determined in step 94 that the autonomous vehicle 20 has reached the movement destination, the process proceeds to step 95, and the autonomous driving control of the autonomous vehicle 20 is terminated.

Returning to FIG. 8 again, when it is determined in step 70 that the entry request to the automatic parking lot 2 is not issued, the process proceeds to step 80, and it is determined whether the current time has reached the movement time set in step 74. When it is determined that the current time has not reached the movement time set in step 74, the processing cycle ends. On the other hand, when it is determined that the current time has reached the movement time set in step 74, the process proceeds to step 81, and based on the list shown in FIG. 5, from the current time to the scheduled leaving time, an empty parking space P having a low degree of sunlight R, preferably an empty parking space P in the shade is searched, and from the current time to the scheduled leaving time, an empty parking space P having a low degree of sunlight R, preferably an empty parking space P in the shade is set as a new movement destination.

Next, in step 82, the travel route from the current parking space P3 to the set new movement destination is set based on the map data of the automatic parking lot 2 stored in the memory 13. Next, in step 83, based on the map data of the automatic parking lot 2 stored in the memory 13 and the image signal of the infrastructure sensor 6, the travel locus and the travel speed of the autonomous vehicle 20 at which the autonomous vehicle 20 does not come into contact with other vehicles and pedestrians are determined. Next, in step 78, an autonomous driving execution command for the autonomous vehicle 20 is issued, and then in step 79, the set new movement destination, travel route, travel locus, and travel speed, and the autonomous driving execution command are transmitted to the autonomous vehicle 20 from the parking management server 5. When the autonomous driving execution command is transmitted from the parking management server 5 to the autonomous vehicle 20, the autonomous driving control routine shown in FIG. 9 is executed, and the autonomous vehicle 20 is autonomously driven to the set new movement destination.

As described above, in the embodiment shown in FIGS. 8 and 9, based on the sunlight state of each parking space P detected by the infrastructure sensor 6, the parking space P having a high degree of sunlight R and the parking space P having a low degree of sunlight R are identified. When there is an entry request for the autonomous vehicle 20 including the solar power generation function, the autonomous vehicle 20 is moved to and parked in the parking space P having a high degree of sunlight R by autonomous driving. In this case, in the embodiment shown in FIGS. 8 and 9, the autonomous vehicle 20 parked in the parking space P having a high degree of sunlight R is moved to the parking space P having a low degree of sunlight R, preferably the parking space P in the shade before the scheduled leaving time.

As described above, the autonomous vehicle 20 parked in the parking space P having a high degree of sunlight R is moved to the parking space P having a low degree of sunlight R, preferably the parking space P in the shade, before the scheduled leaving time, so that the room temperature of the autonomous vehicle 20 can be lowered before the autonomous vehicle 20 leaves the automatic parking lot 2. In this case, the time intervals between the movement time and the scheduled entry and leaving time can be changed according to the room temperature of the parked autonomous vehicle 20 or the position of the sun such that the room temperature of the autonomous vehicle 20 can be sufficiently lowered before the autonomous vehicle 20 leaves the automatic parking lot 2.

What is claimed is:

1. A parking lot management system comprising:

an infrastructure sensor that is able to detect a sunlight state of a parking space in a parking lot; and a notification device that notifies at least one of a vehicle including a solar power generation function and a user of the parking lot of the sunlight state of each parking space detected by the infrastructure sensor, wherein when the infrastructure sensor is able to detect a current actual sunlight state of the parking space in the parking lot, the notification device notifies at least one of the vehicle including the solar power generation function and the user of the parking lot of the current actual sunlight state of the parking space in the parking lot, and when the infrastructure sensor is not able to detect the current actual sunlight state of the parking space in the parking lot, the notification device notifies at least one of the vehicle including the solar power generation function and the user of the parking lot of a latest actual sunlight state of the parking space.

2. The parking lot management system according to claim 1, wherein the notification device notifies at least one of the vehicle including the solar power generation function and the user of the parking lot of the sunlight state of each parking space for regular time intervals.

3. The parking lot management system according to claim 1, wherein based on the sunlight state of each parking space detected by the infrastructure sensor, a degree of sunlight is obtained for each parking space, and the notification device notifies at least one of the vehicle including the solar power generation function and the user of the parking lot of the degree of sunlight.

4. The parking lot management system according to claim 1, comprising a parking management server that manages parking of a vehicle in the parking lot, wherein the parking management server constitutes the notification device.

5. The parking lot management system according to claim 1, wherein based on the sunlight state of each parking space detected by the infrastructure sensor, a parking space having a high degree of sunlight and a parking space having a low degree of sunlight are identified, and when there is an entry request for an autonomous vehicle including a solar power generation function, the autonomous vehicle is moved to and parked in the parking space having the high degree of sunlight by autonomous driving.

6. The parking lot management system according to claim 5, wherein the autonomous vehicle parked in the parking space having the high degree of sunlight is moved to the parking space having the low degree of sunlight before scheduled leaving time.

7. A parking lot management method comprising, by using an infrastructure sensor that is able to detect a sunlight state of a parking space in a parking lot, notifying at least one of a vehicle including a solar power generation function and a user of the parking lot of the sunlight state of each parking space detected by the infrastructure sensor, using a notification device, wherein when the infrastructure sensor is able to detect a current actual sunlight state of the parking space in the parking lot, the current actual sunlight state of the parking space in the parking lot is notified by the notification device to at least one of the vehicle including the solar power generation function and the user of the parking lot of, and when the infrastructure sensor is not able to detect the current actual sunlight state of the parking space in the parking lot, a latest actual sunlight state of the parking space is notified by the notification device to at least one of the vehicle including the solar power generation function and the user of the parking lot.

8. A non-transitory storage medium storing a program that causes a computer to function, by using an infrastructure sensor that is able to detect a sunlight state of a parking space in a parking lot, notifying at least one of a vehicle including a solar power generation function and a user of the parking lot of the sunlight state of each parking space detected by the infrastructure sensor, using a notification device, wherein when the infrastructure sensor is able to detect a current actual sunlight state of the parking space in the parking lot, the current actual sunlight state of the parking space in the parking lot is notified by the notification device to at least one of the vehicle including the solar power generation function and the user of the parking lot of, and when the infrastructure sensor is not able to detect the current actual sunlight state of the parking space in the parking lot, a latest actual sunlight state of the parking space is notified by the notification device to at least one of the vehicle including the solar power generation function and the user of the parking lot.

* * * * *